United States Patent [19]

Lyass et al.

[11] 4,006,027

[45] Feb. 1, 1977

[54] PROCESS FOR PRODUCING FOUNDRY MOUNDS AND CORES

[76] Inventors: Abram Moiseevich Lyass, Sharikopodshipnikovskaya ulitsa, 2, kv. 146; Pavel Afanasievich Borsuk, Nizhne-Pervomaiskaya ulitsa, 59, kv. 10; Zokhrab Gamid Ogly Usubov, B. Cherkizovskaya ulitsa, kvartal 8-11, korpus 21, kv. 106; Viktor Georgievich Kuznetsov, 5 Kozhukhovskaya ulitsa, 10, kv. 36; Naum Yakovlevich Kagan, 2 ulitsa Mariinoi roschi, 14v, kv. 22, all of Moscow; Jury Alexeevich Razumeev, Ulitsa Kolontsova, 7, kv. 6, Mytischi Moskovskoi oblasti; Vladimir Mironovich Bortnik, Eiskaya ulitsa, 9, kv. 26, Moscow; Isai Volfovich Korenbljum, Veernaya ulitsa, 3, korpus 4, kv. 112, Moscow; Valentina Alexeevna Dmitrieva, ulitsa Trofimova, 25, kv. 43., Moscow, all of U.S.S.R.

[22] Filed: May 28, 1975

[21] Appl. No.: 581,480

Related U.S. Application Data

[63] Continuation of Ser. No. 441,446, Feb. 11, 1974, abandoned, which is a continuation of Ser. No. 278,869, Aug. 8, 1972, abandoned.

[52] U.S. Cl. ..... 106/38.5 R; 106/38.6; 106/123 LC; 106/214; 164/37

[51] Int. Cl.[2] ..... B28B 7/34

[58] Field of Search ..... 106/38.3, 38.35, 38.5 R, 106/38.9, 104, 38.7, 38.8, 123 LC, 214; 164/37

[56] References Cited

UNITED STATES PATENTS

| | | | |
|---|---|---|---|
| 3,196,505 | 7/1965 | Moren | 106/38.35 |
| 3,285,756 | 11/1966 | Moren | 106/38.5 |
| 3,662,830 | 5/1972 | Martin | 106/90 |
| 3,804,641 | 4/1974 | Lyass et al. | 106/38.2 |

*Primary Examiner*—Lorenzo B. Hayes
*Attorney, Agent, or Firm*—Holman & Stern

[57] ABSTRACT

Foundry moulds and cores hardening at a room temperature which feature high strength can be produced from a moulding mixture comprising moulding sand, an organic binder capable of interacting with a hardening agent and causing the mixture to harden, the hardening agent being particulate material containing predominantly CaO and $Cl_2O_3$ in a relative molar proportion of from 1.6:1 to 4:1 and from 40 to 98% by weight of the tricalcium aluminate.

As to the organic binder, use may be made of lignosulfonate of an alkali, or an alkali-earth metal, or ammonium or mixtures thereof, a soluble resin produced by pyrolysis of wood pulp and processed with lime, and dextrin.

The foundry moulds and cores can also be produced by pouring a fluid mixture comprising a foaming agent which is additionally introduced into it to render the mixture into the fluid state.

14 Claims, 2 Drawing Figures

PROCESS FOR PRODUCING FOUNDRY MOUNDS AND CORES

Figure 1:
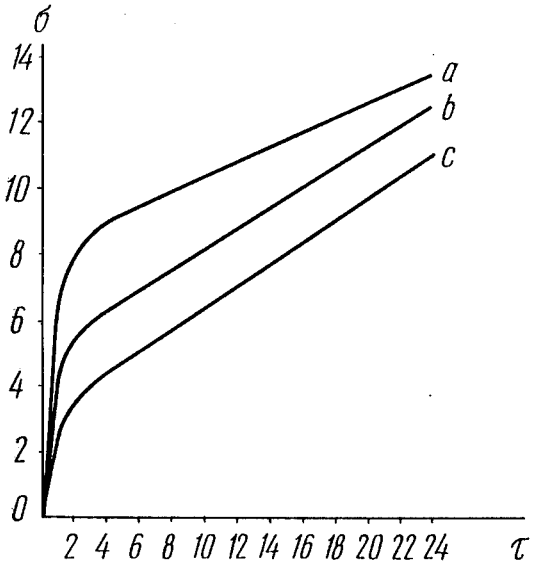

This is a continuation, of application Ser. No. 441,446, filed Feb. 11, 1974 which in turn is a continuation of Ser. No. 278,869, filed Aug. 8, 1972, both now abandoned.

The present invention relates to the field of foundry work and more particularly to a process for producing foundry moulds and cores.

In recent years wide application has been found for methods of producing foundry moulds and cores from self-hardening moulding sands or mixtures, as they do not require additional time-input and expenditures for the drying process needed to impart the requisite strength to the moulds and cores produced thereof.

Methods of making foundry moulds and cores from a self-hardening mixture comprising moulding sand, sodium silicate are widely known and dicalcium silicate.

However the use of these mixtures presents some difficulties associated with the more difficult decoring, enhanced sticking of the moulding mixture to patterns and core boxes, and the complexity and limitation of the hardening control range.

The above said difficulties can be partially eliminated through the use of organic-base binders. The self-hardening mixtures containing moulding sand, a lignosulfonate of an alkali, or an alkali-earth metal, an ammonium or mixtures thereof and a hardening agent are of particular interest in this connection. As to the hardener, a compound of hexavalent chromium and various kinds of cements may be used.

While using the self-hardening mixtures of the above type, a lower hardening rate for the moulds and cores produced thereof has been observed along with a low strength which does not exceed 1.0 kg/cm$^2$ within 1 hr after hardening and has a low gas permeability.

The basic object of the present invention is to provide a process for the production of foundry moulds and cores from a self-hardening moulding mixture whose composition will ensure a substantial enhancement of the strength characteristics of said moulds and core, with the possibility of controlling the hardening rate for improved decoring.

Another object of the present invention is to eliminate the packing operation in the production of foundry moulds and cores.

These and other objects of the invention are accomplished by developing a process for the production of foundry moulds and cores comprising the steps of preparing a self-hardening moulding mixture containing moulding sand, an organic binder and a hardening agent being of particulate material and comprising predominantly CaO and $Al_2O_3$ in a relative molar proportion of from 1.6:1 to 4:1 and containing from 40 to 98% by weight of tricalcium aluminate, and further shaping the resultant mixture and allowing it to harden in the air.

According to the invention the above mixture contains 100 parts by weight of the moulding sand, from 0.15 to 15 parts by weight of the organic binder and from 3 to 12 parts by weight of the hardening agent.

The hardening agent, conforming to the present invention, is a product of interaction between alumo- and calcium-containing materials taken in such a proportion as to ensure the production of the resultant product with a molar CaO:$Al_2O_3$ ratio of from 1.6:1 to 4.0:1 and containing from 40 to 98% by weight of tricalcium aluminate.

As to the alumo-containing materials, commercial aluminum oxide, bauxite, alunite, clay, metallurgical slags maybe used. Another raw material ingredient may constitute lime, limestone, metallurgical slags and other materials from which lime is separated under the effects of reaction heat. Depending on the amount of CaO and $Al_2O_3$ in the above materials, the hardening agent being produced can differ in the tricalcium aluminate contents and, hence, in its activity.

The product produced by sintering is usually ground to obtain a specific surface area of 2000 to 4000 cm$^2$/g, as measured by filtration of air through a layer of particulate material and calculated by the Kozeny-Karman method. The value of the specific surface area of the hardening agent has an important bearing upon the mixture hardening rate and upon the strength of the foundry moulds and cores produced therefrom. Clearly, the larger the specific surface area of the hardening agent, the higher will be the strength and the hardening rate of the mixture produced.

According to the invention, the amount of the hardening agent in the moulding mixture can vary from 3.0 to 12% of the weight of the moulding sand.

The organic binder introduced into the self-hardening moulding mixture, conforming to the invention, may constitute a material capable of interacting with the hardening agent and causing the mixture to harden.

Thus, the binder added to the above mixture may be an alkali, or alkali-earth metal, or an ammonium lignosulfonate or mixtures thereof, are soluble tar obtained in pyrolysis of wood pulp and treated by lime or dextrin.

The most widely spread material containing sodium, calcium or ammonium lignosulfonate or their mixture is the waste products resulting from the production of cellulose from wood pulp by the sulfite process. Hereinafter in the description the product will be referred to as a "sulfite alcohol waste liquor". The sulfite alcohol waste liquor employed in the moulding mixture according to the invention comes from the industry either in a liquid form or in the form of dry concentrates, with the lignosulfonate content varying in the range of from 45-97% by weight. The higher the lignosulfonate content in the sulfite alcohol waste liquor, the smaller the amount necessary in the mixture to obtain the same strength characteristics of the moulds and cores. The lignosulfonate content in the liquid sulfite alcohol waste liquor may be characterized by its specific gravity. According to the present invention, the moulding mixture contains commonly the sulfite alcohol waste liquor having a specific gravity of 1.1 to 1.27 g/cm$^3$, with its lignosulfonate content ranging from 25–55% by weight so that its contents in the mixture will amount to from 0.5–4.0% of the weight of the moulding sand.

Given below are exemplary embodiments of the present invention in which the sulfite alcohol waste liquor is used as the lignosulfonate-containing material. It should be borne in mind that the present invention is in no way limited by the use of this particular lignosulfonate-containing material thereof.

EXAMPLE 1

According to the present invention a self-hardening mixture was prepared by mixing together 100 parts by weight of moulding sand, 10 parts by weight of a hardening agent, 5 parts by weight of sulfite alcohol waste liquor having a specific gravity of 1.24 g/cm$^3$, and containing 46% by weight of lignosulfonate, and 2 parts by weight of water.

The variations of the strength characteristics of the self-hardening moulding mixture described in Example 1 with the times are illustrated by the curves presented in the graph (FIG. 1) ($\tau$ -holding time, hr; $\sigma$ - compression strength, kg/cm$^2$).

The difference is attributable to the fact that the mixtures contained the hardening agent differ in the content of tricalcium aluminate, i.e.:

curve a - 92% by weight (FIG. 1);
curve b - 70% by weight;
curve c - 40% by weight.

As made clear from the graph (FIG. 1), by choosing the hardening agent with a higher or lower content of tricalcium aluminate it is possible to control both the hardening rate and the strength of the foundry moulds and cores.

Conforming to the present invention the hardening rate and strength properties of the moulding mixture can be adjusted by changing the ratio between lignosulfonate included in the sulfite alcohol waste liquor and the hardening agent of the chosen composition.

It has been established that when a moulding mixture in which the ratio between the lignosulfonate of the sulfite alcohol waste liquor and the hardening agent ranges from 1:22 to 1:18 and from 1:1.5 to 1:0.8 by weight it features both the highest hardening rate and strength.

The self-hardening mixture containing the sulfite alcohol waste liquor and the hardening agent in such amounts that the lignosulfonate/hardener ratio varies from 1:18 and 1:1.5 has a long induction hardening period featuring thereby a high bench life along with a high overall strength.

Three exemplary compositions of the moulding mixtures comprising the hardener of the above composition and the sulfite alcohol waste liquor having a specific gravity of 1.24 g/cm$^3$ containing respectively 46% by weight of lignosulfonate are present in Table 1. The ratio between lignosulfonate contained in the sulfite alcohol waste liquor and the hardening agent amounts accordingly to 1:5, 1:2.5 and 1:5 by weight for these mixtures.

Table 1.

| Mixture components | Parts by weight | | |
|---|---|---|---|
| | Mixture 1 | Mixture 2 | Mixture 3 |
| Quartz sand | 100 | 100 | 100 |
| Hardening agent | 10 | 10 | 4.5 |
| Sulfite alcohol waste liquor | 5 | 8 | 6.5 |
| Water | 2 | 2 | 2 |

Figure 2:
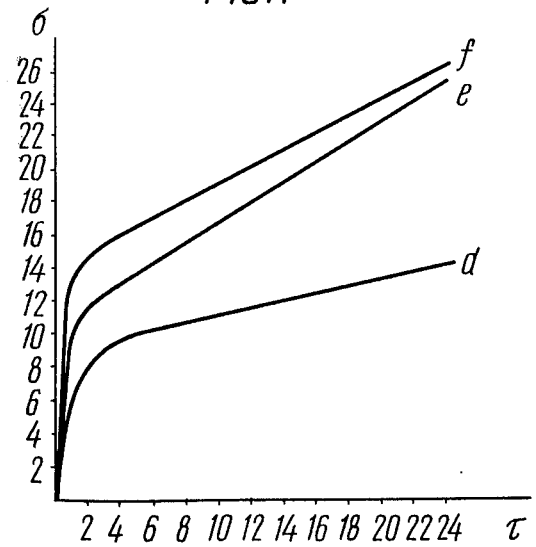

Curves d, e, f of the graph (FIG. 2) illustrate the variations of compression strengths $\sigma$ (kg/cm$^2$) of mixtures 1, 2 and 3 accordingly (Table I) versus their air holding time in (hr).

As shown by the graph (FIG. 2) the higher the ratio between the lignosulfonate and hardener contents (Mixture 3), the higher the hardening rate and strength of the mixture according to the present invention.

Another binder added to the self-hardening moulding mixture conforming to the invention may constitute the product known as a "KBC binder". This product and its process of manufacture are described by V. A. Sokolova et al, "Quick-Setting Binder for Moulding Mixtures", "Mashinostroyenie Publishers," Moscow, 1968, pages 5 and 94–95. The KBC binder is prepared by treating with aqueous lime solution a soluble resin known as "KB$_0$" which, in accordance with USSR State Standard GOST-9006-62, is a soluble resin produced during the pyrolysis of wood pulp and from which volatile constituents have been evaporated and phenols have been extracted with sulphuric ether. The chemical composition of the KB$_0$ resin consists essentially of substantially equal parts by weight of (a) levoglucosane and (b) hydroxy-acids and their lactones as calculated for $\alpha$-oxy -$\gamma$-valerolactone, and (c) approximately 10% by weight of ethylene glycol and its acetic esters based on the total weight of the levoglucosane and the hydroxy-acids and lactones. In preparing the KBC binder, the KB$_0$ resin is reacted with 5–7% lime in the form of aqueous lime solution to partially neutralize the hydroxy-acids and lactones and form calcium salts thereof. The resulting KBC binder is an aqueous composition whose solids content consists essentially of substantially equal parts of weight of (a) levoglucosane and (b) calcium salts of hydroxy-acids, free hydroxy-acids and their lactones as calculated for $\alpha$-oxy -$\gamma$-valerolactone, and (c) approximately 10% by weight of ethylene glycol and its acetic esters based on the total weight of the levoglucosane, the calcium salts of hydroxy-acids, the free hydroxy-acids and the lactones.

According to the invention, the KBC binder having a specific gravity from 1.30–1.32 g/cm$^3$ with the solid contents amounting to 65% by weight is usually introduced into the moulding mixture.

EXAMPLE 2

100 parts by weight of moulding sand were mixed with 10 parts by weight of a hardener containing 92% by weight of tricalcium aluminate, next 4.5 parts by weight of the KBC binder having a specific gravity of 1.30 g/cm$^3$, a solid content of 65% by weight were added and tempered with 5 parts by weight of water.

The cores produced from the above mixture can be removed in 15 min.

The compression strengths (kg/cm$^2$) are:
after hardening for 1 hr — 6.5;
after hardening for 3 hrs — 10.0;
after hardening for 24 hrs — 16.0.

When the KBC binder is employed the best results are obtained with weight ratio between the KBC binder (when calculated for solids) and the hardener ranging from 1:15 to 1:0.8 by weight.

In comparison with the sulfite alcohol waste liquor, the KBC binder makes it possible to control the induction period of the hardening process and, hence, the bench life of the moulding mixture over a more extensive range.

According to the present invention a combination of the sulfite alcohol waste liquor and the KBC binder can be used as the binding agent. It would be expedient if the weight ratio between the sulfite alcohol waste liquor and the KBC binder (when calculated for solids) were to be within 1:1.5 and 1:4 by weight.

EXAMPLE 3

A mixture was prepared by mixing 100 parts by weight of moulding sand, 10 parts by weight of a binder containing 92% by weight of tricalcium aluminate, 1.2 parts by weight of the sulfite alcohol waste liquor having a specific gravity of 1.24 g/cm$^3$ and containing respectively 46% by weight of lignosulfonate, 3.8 parts by weight of the KBC binder having a specific gravity of 1.30 g/cm³ and solid contents of 65% by weight and 5 parts by weight of water.

The cores produced from this mixture were withdrawn within 15 min.

The compression strengths (kg/cm²) is were:
after hardening for 1 hr — 7;
after hardening for 3 hrs — 10;
after hardening for 24 hr — 17.

According to the present invention, dextrin can also be used in the self-hardening mixture as a binder. The best results are obtained with the weight ratio between the dextrin and hardener contents ranges within 1:5 to 1:3.

EXAMPLE 4

100 parts by weight of moulding sand were mixed with 10 parts by weight of a hardener containing 92% by weight of tricalcium aluminate, 1.3 parts by weight of dextrin and 6 parts by weight of water.

The cores made from this mixture were removed within 25 min.

The compression strengths (kg/cm²) were:
after hardening for 1 hr — 4.0;
after hardening for 3 hrs — 4.5;
after hardening for 24 hrs — 11.0.

According to the invention the method of hardening the moulding mixture based on the interaction between the hardening agent, whose composition is given hereinbefore, and the organic binder is also suited for a fluid moulding mixture, containing apart from the moulding sand an organic binder, and the hardener, a foaming agent taken in quantities large enough to render the mixture into the fluid state.

The amount of the foaming agent shall range from 0.1 to 0.6% by weight of the moulding sand.

The foaming agents added to the moulding mixtures may constitute anionic, cationic and nonionigenic surface-active materials or surfactants possessing a foaming action upon being intermixed with the components of the mixture. These may be alkyl aryl sulfonates, alkyl sulfonates, alkyl sulfates, the product of oxyethylation of alcohols, alkyl phenols, fatty amines, aliphatic acids, alkyl naphthols mercaptans, and quaternary ammonium compounds.

A most suitable foaming agent for the moulding mixture conforming to this invention is an anionic-type surface-active compounds, such as sodium alkyl aryl sulfonate, ensuring that the production of the fluid moulding mixture featuring high flawability and a requisite foam stability in the mixture, i.e. that the property retains mobility during the length of time sufficient to pour the mixture into core boxes and on patterns.

An advantage of the fluid moulding mixture lies in its high flowability by which virtue the conventional sand compacting technique can be dropped and replaced by pouring the mixture into the core and mould boxes during the production of the moulds and cores.

EXAMPLE 5

A fluid moulding mixture was prepared by mixing together 100 parts by weight of moulding sand, 10 parts by weigh of a hardening agent containing 92% by weight of tricalcium aluminate, 8 parts by weight of a sulfite alcohol waste liquor a specific gravity of 1.24 g/cm³ and containing 46% by weight of lignosulfonate, 0.6 parts by weight of sodium alkyl aryl sulfonate having a trademark ΩC-PAC, and 2.0 parts by weight of water.

The mixture features a 350-mm. flowability as determined by the cone test.

Foam stability = 20 min.

The compression strengths (kg/cm²) were:
after hardening for 1 hr — 6;
after hardening for 3 hrs — 8;
after hardening for 24 hrs — 15.

EXAMPLE 6

A fluid moulding mixture was prepared by mixing together 100 parts by weight of moulding sand, 5 parts by weight of a hardening agent containing 92% by weight of tricalcium aluminate, 7.5 parts by weight of a sulfite alcohol waste liquor having a specific gravity of 1.24 g/cm³ and containing 46% by weight of lignosulfonate, 0.17 parts by weight of sodium alkyl aryl sulfonate with the ΩC-PAC trademark, and 2.5 parts by weight of water.

Extraction of cores was effected within 10 min. upon pouring the mixture into a core box.

The compression strengths (kg/cm²) were:
after hardening for 10 min. — 9;
after hardening for 1 hr — 12;
after hardening for 24 hrs — 20.

What we claim is:

1. A process for the production of foundry moulds and cores comprising the steps of preparing a mixture of moulding sand, an organic binder and a hardening agent, said hardening agent being of particulate material and comprising predominantly CaO and $Al_2O_3$ in a relative molar proportion of from 1.6:1 to 4:1 and containing from 40 to 98% by weight of tricalcium aluminate, shaping the resultant mixture and allowing it to harden in atmospheric air, said organic binder being selected from the group consisting of (A) lignosulfonates of an alkali or alkali-earth metal, an ammonium ion or mixtures thereof, (B) dextrin, and (C) an aqueous composition whose solids content consists essentially of substantially equal parts by weight of (a) levoglucosane and (b) calcium salts of hydroxy-acids, free hydroxy-acids and their lactones as calculated for α-oxy-γ-valerolactone, and (c) approximately 10% by weight of ethylene glycol and its acetic esters based on the total weight of (a) and (b).

2. A process for the production of foundry moulds and cores which comprises the steps of preparing a mixture of 100 parts by weight of moulding sand, from 0.15 to 15 parts by weight of an organic binder and from 3 to 12 parts by weight of a hardening agent, said hardening agent being of particulate material and comprising predominantly CaO and $Al_2O_3$ in a relative molar proportion of from 1.6:1 to 4:1 and containing from 40 to 98% by weight of tricalcium aluminate, shaping the resultant mixture and allowing it to harden in atmospheric air, said organic binder being selected from the group consisting of (A) lignosulfonates of an alkali or alkali-earth metal, an ammonium ion or mixtures thereof, (B) dextrin, and (C) an aqueous composition whose solids content consists essentially of substantially equal parts by weight of (a) levoglucosane and (b) calcium salts of hydroxy-acids, free hydroxy-acids and their lactones as calculated for α-oxy-γ-valerolactone, and (c) approximately 10% by weight of ethylene glycol and its acetic esters based on the total weight of (a) and (b).

3. A process as claimed in claim 2 in which the organic binder is a lignosulfonate of an alkali or alkali-earth metal, an ammonium ion or mixtures thereof, and amounting to from 0.15-15 parts by weight.

4. A process as claimed in claim 3 in which the said lignosulfonate is a sulfite alcohol waste liquor.

5. A process as claimed in claim 2 in which the organic binder is an aqueous composition whose solids content consists essentially of substantially equal parts by weight of (a) levoglucosane and (b) calcium salts of hydroxy-acids, free hydroxy-acids and their lactones as calculated for α-oxy-γ-valerolactone, and (c) approximately 10% by weight of ethylene glycol and its acetic esters based on the total weight of (a) and (b), said organic binder being introduced in amounts ranging from 0.2 to 15 parts by weight.

6. A process as claimed in claim 2 in which the organic binder is dextrin introduced in amounts ranging from 0.6 to 4.0 parts by weight.

7. A process as claimed in claim 2, in which a surfactant with foaming action is added to said mixture in amounts of from 0.1 to 0.6% of the weight of the moulding sand.

8. A self-hardening moulding mixture for the production of foundry moulds and cores comprising moulding sand, an organic binder, and a hardening agent which is of particulate material and containing predominantly CaO and $Al_2O_3$ in a relative molar proportion of from 1.6:1 to 4:1 and containing from 40 to 98% by weight of tricalcium aluminate, said organic binder being selected from the group consisting of (A) lignosulfonates of an alkali or alkali-earth metal, an ammonium ion or mixtures thereof (B) dextrin, and (C) an aqueous composition whose solids content consists essentially of substantially equal parts by weight of (a) levoglucosane and (b) calcium salts of hydroxy-acids, free hydroxy-acids and their lactones as calculated for α-oxy-γ-valerolactone, and (c) approximately 10% by weight of ethylene glycol and its acetic esters based on the total weight of (a) and (b).

9. A self-hardening moulding mixture for the production of foundry moulds and cores comprising 100 parts by weight of moulding sand, from 0.15 to 15 parts by weight of an organic binder and from 3 to 12 parts by weight of a hardening agent, said hardening agent being of particulate material and comprising predominantly CaO and $Al_2O_3$ in a relative molar proportion of from 1.6:1 to 4:1 and containing from 40 to 98% by weight of tricalcium aluminate, said organic binder being selected from the group consisting of (A) lignosulfonates of an alkali or alkali-earth metal, an ammonium ion or mixtures there, (B) dextrin, and (C) an aqueous composition whose solids content consists essentially of substantially equal parts by weight of (a) levoglucosane and (b) calcium salts of hydroxy-acids, free hydroxy-acids and their lactones as calculated for α-oxy-γ-valerolactone, and (c) approximately 10% by weight by ethylene glycol and its acetic esters based on the total weight of (a) and (b).

10. A moulding mixture as claimed in claim 9 in which the organic binder is a lignosulfonate of an alkali or alkali-earth metal, an ammonium ion or mixtures thereof, and amounting to from 0.15–15 parts by weight.

11. A moulding mixture as claimed in claim 10 in which the said lignosulfonate is a sulfite alcohol waste liquor.

12. A moulding mixture as claimed in claim 9 in which the organic binder is an aqueous composition whose solids content consists essentially of substantially equal parts by weight of (a) levoglucosane and (b) calcium salts of hydroxy-acids, free hydroxy-acids and their lactones as calculated for α-oxy-γ-valerolactone, and (c) approximately 10% by weight of ethylene glycol and its acetic esters based on the total weight of (a) and (b), said organic binder being introduced in amounts ranging from 0.2 to 15 parts by weight.

13. A moulding mixture as claimed in claim 9 in which the organic binder is dextrin introduced in amounts ranging from 0.6 to 4.0 parts by weight.

14. A moulding mixture as claimed in claim 9 which comprises additionally a surfactant with foaming action introduced in amounts ranging from 0.1 to 0.6% of the weight of the moulding sand.

* * * * *